US006152237A

United States Patent [19]

Hartman et al.

[11] Patent Number: 6,152,237

[45] Date of Patent: Nov. 28, 2000

[54] METHOD FOR AUTOMATICALLY CONTROLLING THE ARTICULATION ANGLE OF A MOTOR GRADER

[75] Inventors: Matthew A. Hartman, Bloomington; Craig B. Kelley, Dunlap; Bernie D. Lunsford, Lowpoint; Mark D. Shane, Princeville; Daniel E. Shearer, Metamora, all of Ill.

[73] Assignee: Caterpillar Inc., Peoria, Ill.

[21] Appl. No.: 09/210,511

[22] Filed: Dec. 11, 1998

[51] Int. Cl.[7] ..... A01B 79/00

[52] U.S. Cl. ..... 172/1; 172/2; 172/789

[58] Field of Search ..... 172/2, 4, 4.5, 5, 172/779, 780, 781, 789, 1; 701/50; 180/131

[56] References Cited

U.S. PATENT DOCUMENTS

| | | | |
|---|---|---|---|
| 4,159,474 | 6/1979 | Wooldridge | 340/684 |
| 4,373,603 | 2/1983 | Nelson | 180/236 |
| 4,508,176 | 4/1985 | Wiegardt et al. | 172/7 |
| 4,726,175 | 2/1988 | Day et al. | 172/5 X |
| 4,852,659 | 8/1989 | Ross et al. | 172/789 |
| 4,913,070 | 4/1990 | Morrison, Jr. | 111/135 |
| 4,926,948 | 5/1990 | Davidson et al. | 172/4.5 |
| 4,934,463 | 6/1990 | Ishida et al. | 172/4.5 |
| 5,261,495 | 11/1993 | Szymczak | 172/2 |
| 5,421,416 | 6/1995 | Orbach et al. | 172/4 |
| 5,426,874 | 6/1995 | Nakata et al. | 37/348 |
| 5,462,122 | 10/1995 | Yamamoto et al. | 172/2 |
| 5,503,232 | 4/1996 | Matsushita et al. | 172/2 |
| 5,509,486 | 4/1996 | Anderson | 172/5 X |
| 5,551,518 | 9/1996 | Stratton | 172/4.5 |
| 5,715,665 | 2/1998 | Diekhans et al. | 172/4.5 X |
| 5,764,511 | 6/1998 | Henderson | 172/4.5 X |
| 5,905,968 | 5/1999 | Staub et al. | 172/4.5 X |
| 5,918,682 | 7/1999 | Fan et al. | 172/4.5 X |

OTHER PUBLICATIONS

John Deere 570B Motor Grader brochure, p. 2, Jun. 1995.

*Primary Examiner*—Victor Batson
*Attorney, Agent, or Firm*—Howard & Howard

[57] ABSTRACT

A method for automatically rotating a motor grader to a predetermined articulation angle. The method includes the steps of: providing an electronic controller, a displacement sensor, articulation cylinders, and an input switch; obtaining information from the displacement sensor indicating the present articulation angle of the motor grader; receiving an input signal from the input switch requesting a predetermined articulation angle; and producing a control signal for actuating the articulation cylinders to rotate the motor grader from the present articulation angle to the predetermined articulation angle.

5 Claims, 5 Drawing Sheets

METHOD FOR AUTOMATICALLY CONTROLLING THE ARTICULATION ANGLE OF A MOTOR GRADER

TECHNICAL FIELD

The present invention relates generally to a method for automatically controlling the articulation angle of a motor grader and, more particularly, for automatically rotating the motor grader to a predetermined articulation angle.

BACKGROUND ART

Motor graders include many manual controls to steer the grader, position an implement or blade, and articulate the frame of the grader. A motor grader is adjusted to an articulation angle by rotating the front frame of the grader relative to the rear frame of the grader.

Currently, an operator must use a hand lever to manually adjust the articulation angle of the motor grader. Typically, the operator desires to set the motor grader to a full right articulation angle, a full left articulation angle, or a neutral articulation angle. Often, the operator must manually adjust the articulation angle while performing other tasks, such as repositioning the blade and steering the grader. To increase efficiency and allow the operator to concentrate on other operational tasks, it is desirable to provide a method for automatically controlling the articulation angle of a motor grader.

The present invention is directed to overcoming one or more of the problems set forth above.

DISCLOSURE OF THE INVENTION

The present invention provides a method for automatically controlling the articulation angle of a motor grader. The method includes the steps of: providing an electronic controller, a displacement sensor, articulation cylinders, and an input switch; obtaining information from the displacement sensor indicating the present articulation angle of the motor grader; receiving an input signal from the input switch requesting a predetermined articulation angle; and producing a control signal for actuating the articulation cylinders to rotate the motor grader from the present articulation angle to the predetermined articulation angle.

BRIEF DESCRIPTION OF THE DRAWINGS

Other advantages of the present invention will be readily appreciated as the same becomes better understood by reference to the following detailed description when considered in connection with the accompanying drawings wherein.

BEST MODE FOR CARRYING OUT THE INVENTION

Figure 1:
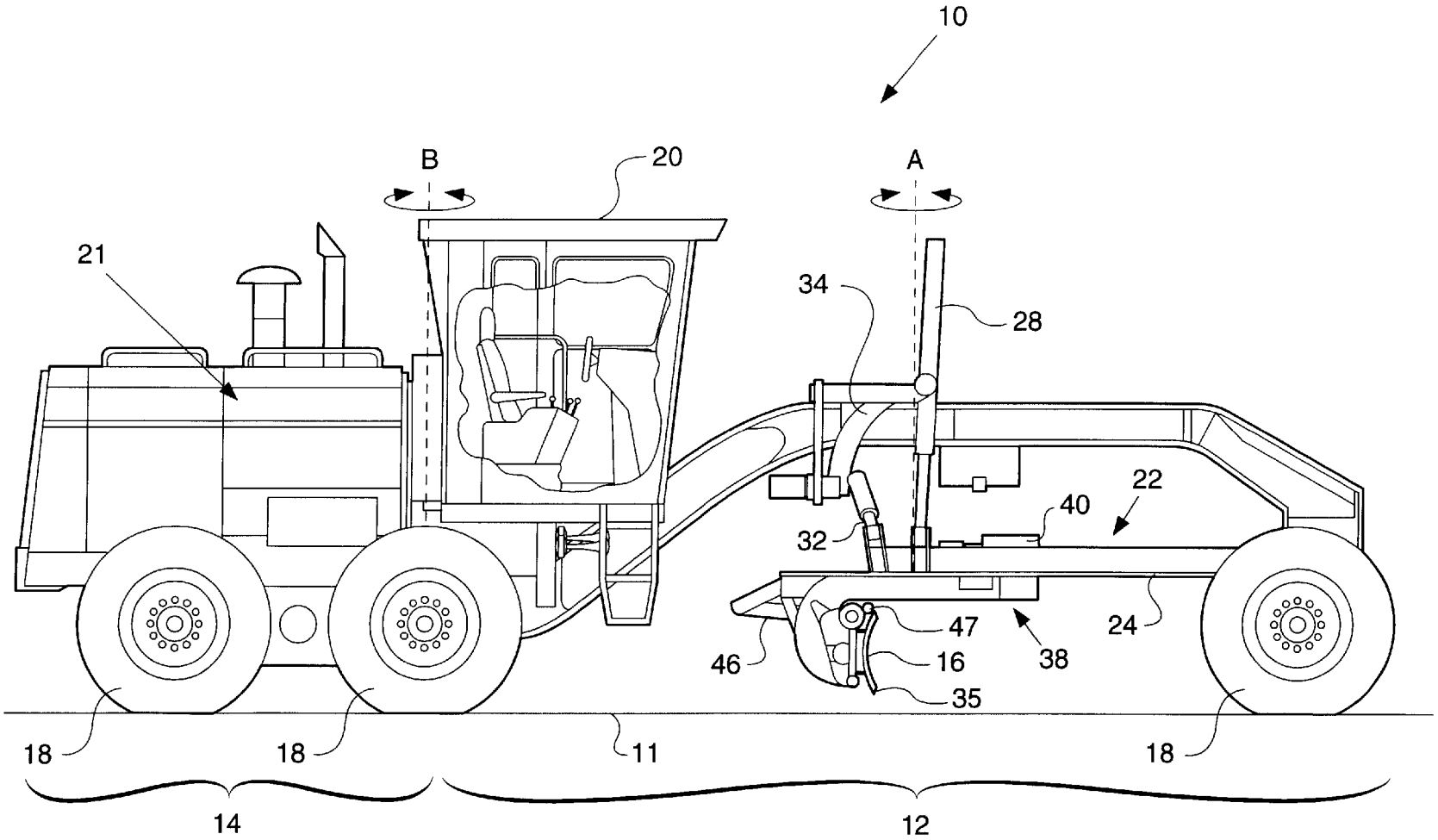
FIG. 1 is a side view of a motor grader.
Figure 2:
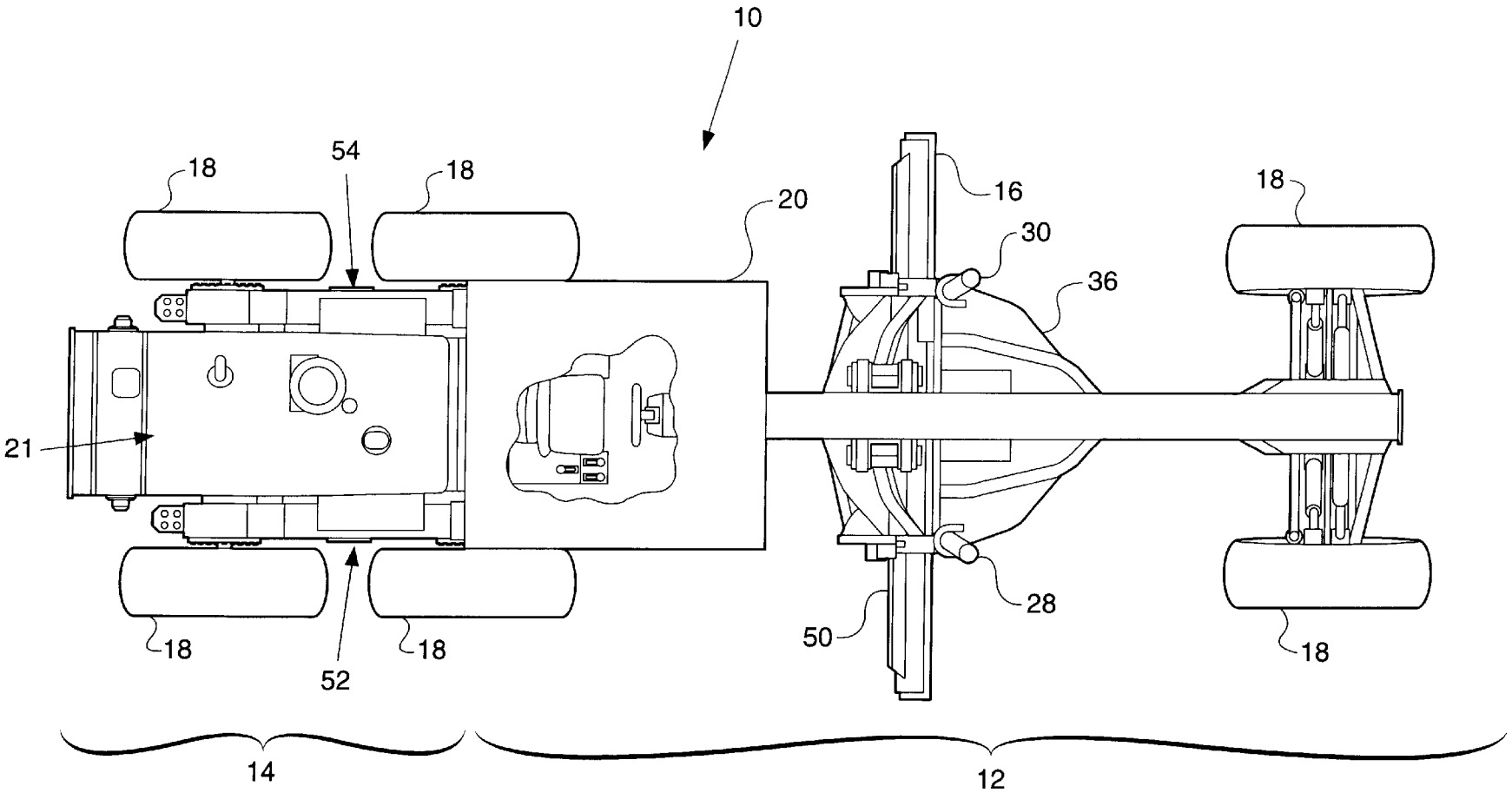
FIG. 2 is a top view of the motor grader.

Referring to the Figures, wherein like numerals indicate like or corresponding parts throughout the several views, a motor grader is shown generally at 10 in FIGS. 1 and 2. The motor grader 10 is used primarily as a finishing tool to sculpt a surface of earth 11 to a final arrangement. Rather than moving large quantities of earth in the direction of travel like other machines, such as a bulldozer, the motor grader 10 typically moves relatively small quantities of earth from side to side. In other words, the motor grader 10 typically moves earth across the area being graded, not straight ahead.

The motor grader 10 includes a front frame 12, a rear frame 14, and a blade 16. The front and rear frames 12 and 14 are supported by tires 18. An operator cab 20 containing the many controls necessary to operate the motor grader 10 is mounted on the front frame 12. An engine, shown generally at 21, is used to drive or power the motor grader 10. The engine 21 is mounted on the rear frame 14. The blade 16, sometimes referred to as a moldboard, is used to move earth. The blade 16 is mounted on a linkage assembly, shown generally at 22. The linkage assembly 22 allows the blade 16 to be moved to a variety of different positions relative to the motor grader 10. Starting at the front of the motor grader 10 and working rearward toward the blade 16, the linkage assembly 22 includes a drawbar 24.

The drawbar 24 is mounted to the front frame 12 with a ball joint. The position of the drawbar 24 is controlled by three hydraulic cylinders, commonly referred to as a right lift cylinder 28, a left lift cylinder 30, and a center shift cylinder 32. A coupling, shown generally at 34, connects the three cylinders 28, 30, and 32 to the front frame 12. The coupling 34 can be moved during blade repositioning but is fixed stationary during earthmoving operations. The height of the blade 16 with respect to the surface of earth 11 below the motor grader 10, commonly referred to as blade height, is controlled primarily with the right and left lift cylinders 28 and 30. The right and left lift cylinders 28 and 30 can be controlled independently and, thus, used to angle a bottom cutting edge 35 of the blade 16 relative to the surface of earth 11. The center shift cylinder 32 is used primarily to sideshift the drawbar 24, and all the components mounted to the end of the drawbar, relative to the front frame 12. This sideshift is commonly referred to as drawbar sideshift or circle centershift.

Figure 3:
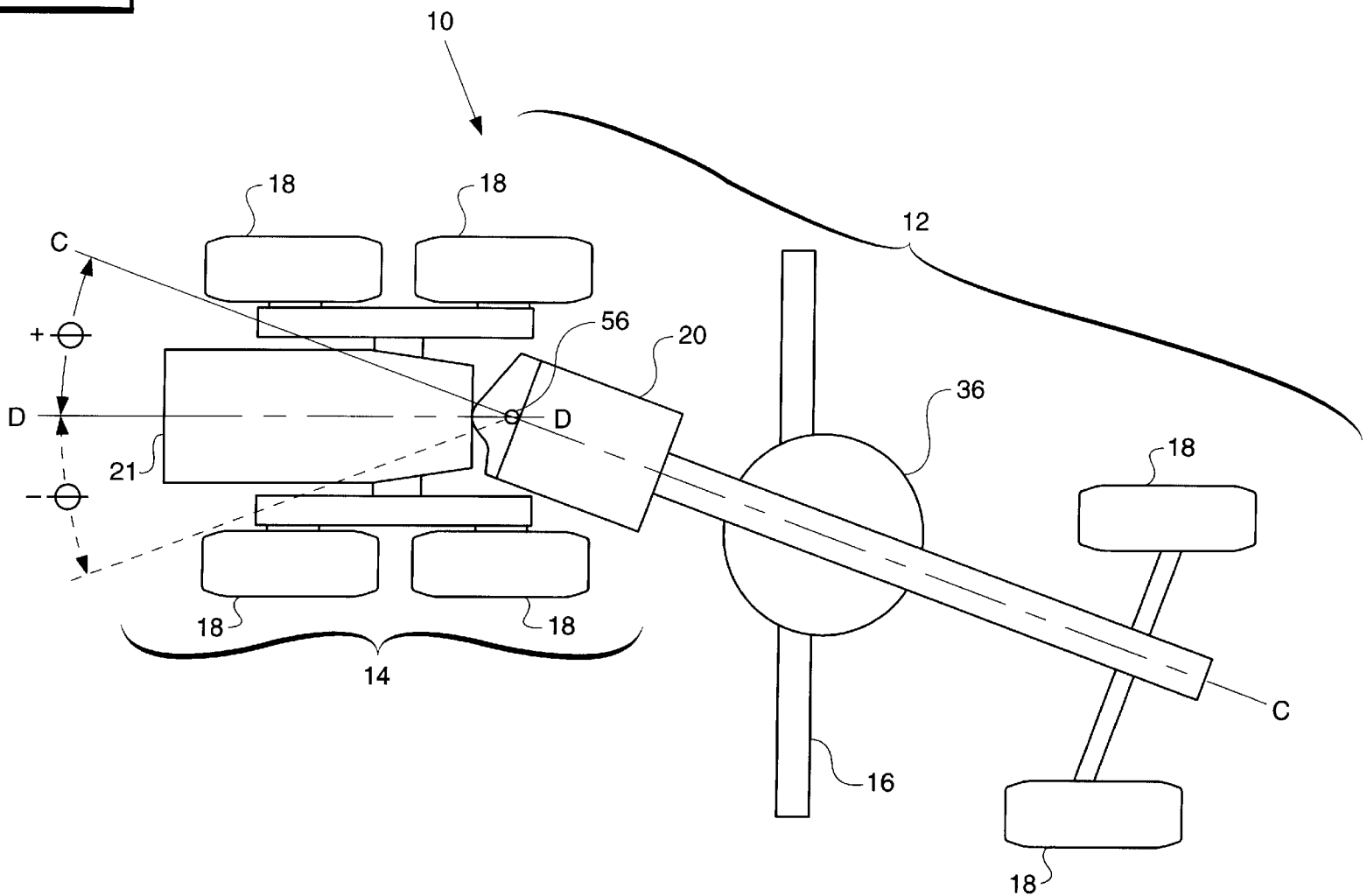
FIG. 3 is a top schematic view of the motor grader rotated to a full right articulation angle.

The drawbar 24 includes a large, flat plate, commonly referred to as a yoke plate 36, as shown in FIGS. 2 and 3. Beneath the yoke plate 36 is a large gear, commonly referred to as a circle 38. The circle 38 is rotated by a hydraulic motor, commonly referred to as a circle drive 40, as shown in FIG. 2. The rotation of the circle 38 by the circle drive 40, commonly referred to as circle turn, pivots the blade 16 about an axis A fixed to the drawbar 24 to establish a blade cutting angle. The blade cutting angle is defined as the angle of the blade 16 relative to the front frame 12. At a zero degree blade cutting angle, the blade 16 is aligned at a right angle to the front frame 12.

The blade 16 is mounted to a hinge on the circle 38 with a bracket. A blade tip cylinder 46 is used to pitch the bracket forward or rearward. In other words, the blade tip cylinder 46 is used to tip a top edge 47 of the blade 16 ahead of or behind the bottom cutting edge 35 of the blade 16. The position of the top edge 47 of the blade 16 relative to the bottom cutting edge 35 of the blade 16 is commonly referred to as blade tip.

The blade 16 is mounted to a sliding joint in the bracket allowing the blade 16 to be slid or shifted from side to side relative to the bracket or the circle 38. This side to side shift is commonly referred to as blade side shift. A side shift cylinder 50 is used to control the blade sideshift.

Referring now to FIG. 2, a right articulation cylinder, shown generally at 52, is mounted to the right side of the rear frame 14 and a left articulation cylinder, shown generally at 54, is mounted to the left side of the rear frame 14. The right and left articulation cylinders 52 and 54 are used to rotate the front frame 12 about an axis B shown in FIG. 1. The axis B is commonly referred to as the articulation axis. In FIG. 2, the motor grader 10 is positioned in a neutral or zero articulation angle.

FIG. 3 is a top schematic view of the motor grader 10 with the front frame 12 rotated to a full right articulation angle +θ. The articulation angle θ is formed by the intersection of the longitudinal axis C of the front frame 12 and the longitudinal axis D of the rear frame 14. An articulation joint 56 connects the front frame 12 and the rear frame 14. A displacement sensor, used to measure the articulation angle θ, is positioned at the articulation joint 56. Preferably, the displacement sensor is a rotary sensor; however, other types of sensors may be used for measuring the displacement at the articulation joint 56, e.g., resolvers, lvdt's and the like. A full left articulation angle −θ, shown in phantom lines in FIG. 3, is a mirror image of the full right articulation angle +θ. The motor grader 10 may be operated with the front frame 12 rotated to the full right articulation angle +θ, the full left articulation angle −θ, or any angle therebetween.

Figure 4:
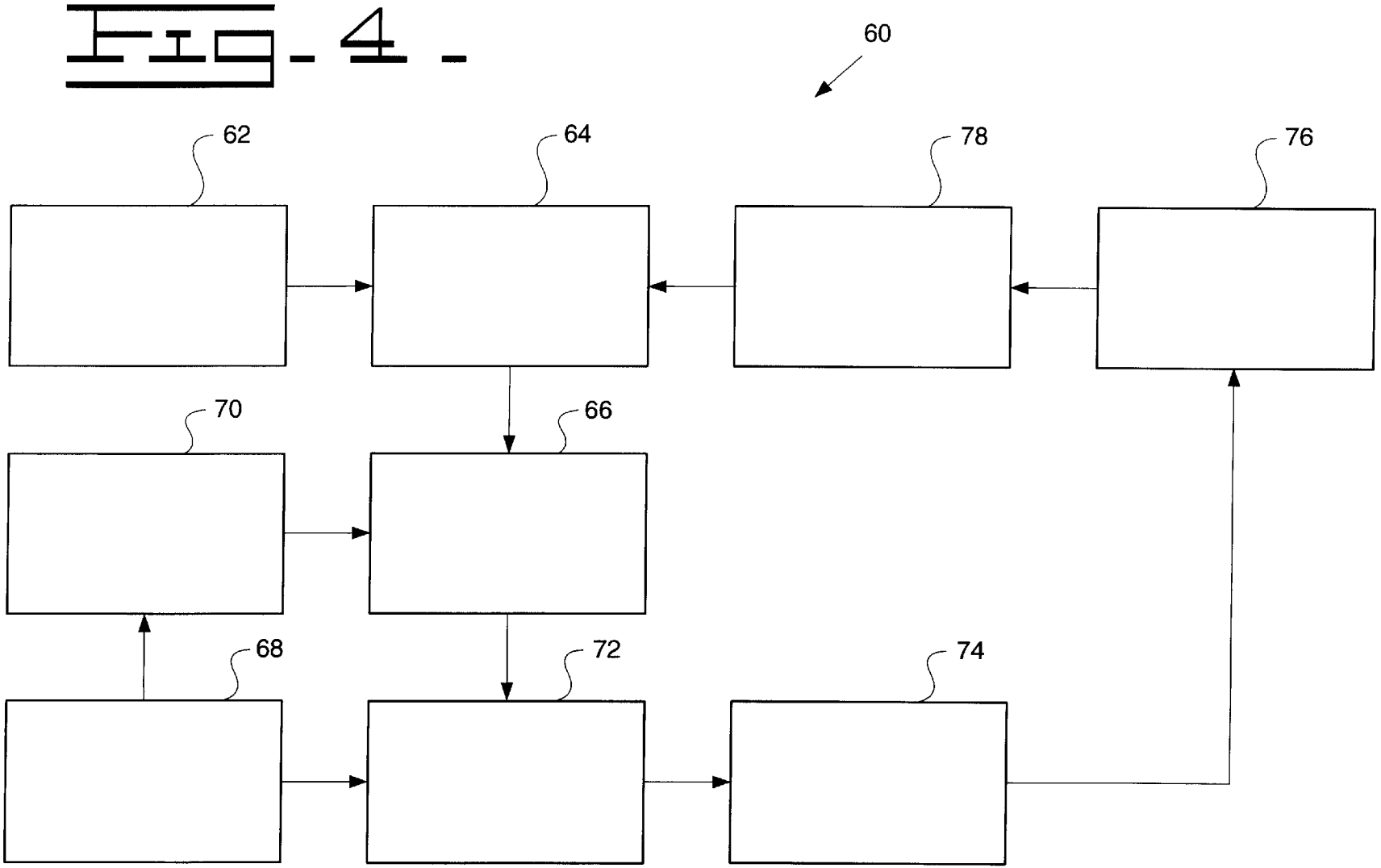
FIG. 4 is a schematic block diagram of an electro-hydraulic control system for the motor grader.

FIG. 4 is a schematic block diagram of an electro-hydraulic control system 60 for the motor grader 10. The control system 60 is designed to control the blade 16 and the articulation angle θ. The system 60 includes electronic manual controls, represented by block 62, which may include devices such as an operator lever, pedal, joystick, or other device for inputting information. The manual controls transform the actions of an operator into electrical input signals. These input signals carry operational information to an electronic control computer, represented by block 64.

The control computer 64 receives the electrical inputs signals produced by the manual controls 62, processes the operational information carried by the input signals, and transmits control signals to drive solenoids in electro-hydraulic actuators, represented by block 66.

The hydraulic portion of the control system 60 requires both high hydraulic pressure and low pilot pressure. High hydraulic pressure is provided by a hydraulic pump, represented by block 68. The hydraulic pump 68 receives a rotary motion, typically from the engine 21 of the motor grader 10, and produces high hydraulic pressure. Low pilot pressure is provided by a hydraulic pressure reducing valve, represented by block 70. The hydraulic pressure reducing valve 70 receives high hydraulic pressure from the hydraulic pump 68 and supplies low pilot pressure to the electro-hydraulic actuators 66.

Each electro-hydraulic actuator 66 includes an electrical solenoid and a hydraulic valve. The solenoid receives control signals from the electronic control computer 64 and produces a controlled mechanical movement of a core stem of the actuator 66. The hydraulic valve receives both the controlled mechanical movement of the core stem of the actuator 66 and low pilot pressure from the hydraulic pressure reducing valve 70 and produces controlled pilot hydraulic pressure for hydraulic valves, represented by block 72.

The hydraulic valves 72 receive both controlled pilot hydraulic pressure from the electro-hydraulic actuators 66 and high hydraulic pressure from the hydraulic pump 68 and produce controlled high hydraulic pressure for hydraulic actuators, cylinders, and motors, represented by block 74.

The hydraulic actuators, cylinders, and motors 74 receive controlled high hydraulic pressure from the hydraulic valves 72 and produce mechanical force to move the front frame 12 of the grader 10 and several mechanical linkages, represented by block 76. As described above, movement of the front frame 12 of the grader 10 with respect to the rear frame 14 of the grader 10 establishes the articulation angle θ. Movement of the mechanical linkages establishes the position of the blade 16.

Each hydraulic actuator, cylinder, and motor 74, such as the lift cylinders 28 and 30 and the circle drive motor 40, includes an electronic position sensor, represented by block 78. The electronic position sensors 78 transmit information regarding the position of its respective hydraulic actuator, cylinder, or motor 76 to the electronic control computer 64. In this manner, the control computer 64 can determine the position the blade 16. The control computer 64 further receives articulation angle information from the displacement sensor, also represented by block 78, positioned at the articulation joint 56. With such position and angle information, the control computer 64 can perform additional operations.

In accordance with the scope of the present invention, one such operation is automatically rotating the motor grader 10 to a predetermined articulation angle. Thus, the present invention provides a method for automatically controlling the articulation angle θ of the motor grader 10. The method includes the steps of: providing an electronic controller, a displacement sensor, articulation cylinders, and an input switch; obtaining information from the displacement sensor indicating the present articulation angle of the motor grader; receiving an input signal from the input switch requesting a predetermined articulation angle; and producing a control signal for actuating the articulation cylinders to rotate the motor grader from the present articulation angle to the predetermined articulation angle.

In a first embodiment, the predetermined articulation angle is defined as a maximum right articulation angle, a maximum left articulation angle, and/or a neutral articulation angle.

In a second embodiment, the motor grader includes a front frame having a longitudinal axis and a rear frame having a longitudinal axis and the predetermined articulation angle is defined as the angle formed by the intersection of the longitudinal axis of the front frame and the longitudinal axis of the rear frame. Thus, a neutral articulation angle is defined as a zero degree angle formed between the intersection of the longitudinal axis of the front frame and the longitudinal axis of the rear frame.

Figure 5:
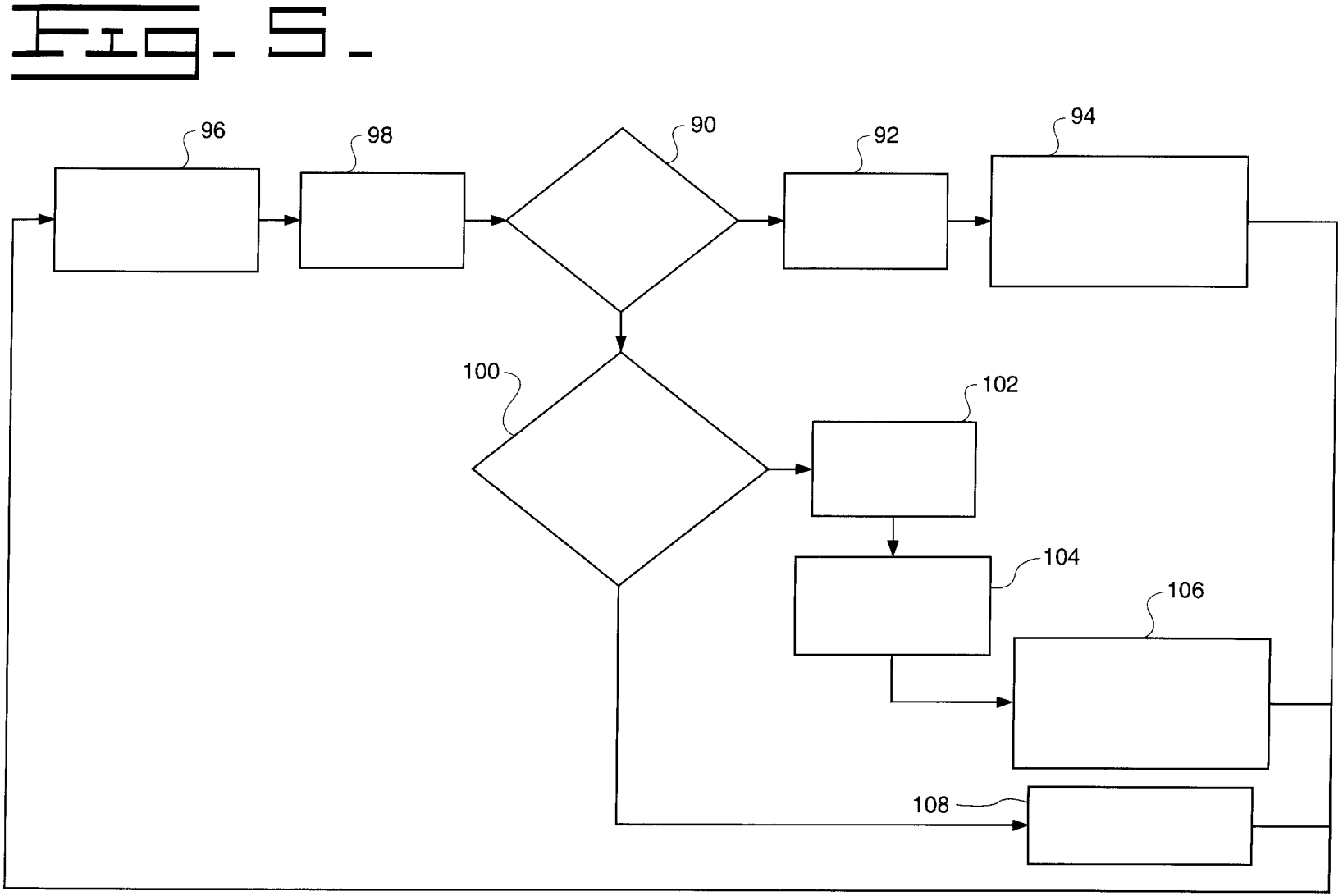
FIG. 5 is a flow chart illustrating a method for automatically controlling the articulation angle of the motor grader in accordance with the present invention.

Referring now to FIG. 5, a flow chart illustrating a preferred method for automatically controlling the articulation angle of the motor grader is shown. As will be appreciated by one of ordinary skill in the art, although the flow chart illustrates sequential steps, the particular order of processing is not important to achieving the objects of the present invention. As will also be recognized, the method illustrated may be performed in software, hardware, or a combination of both as in a preferred embodiment of the present invention.

In the preferred method, an operator is provided with both automatic and manual controls to adjust the articulation angle of the motor grader. Initially, it is determined whether the operator is using the manual controls, as represented by block 90. If the operator is using the manual controls, the automatic position control is turned off, as illustrated by block 92. The control computer produces and transmits a control signal to actuate the articulation cylinders in accordance with the action requested by the manual control, as represented by 94. The program waits for the next synchronized control time, as illustrated by 96, and then interprets the next automatic or manual control input signal, as represented by block 98.

If the operator is not using the manual controls, it is determined if the operator has requested automatic position control, as illustrated by block 100. If the operator has requested automatic position control, the automatic position control is turned on, as represented by block 102. Information regarding the actual articulation angle is obtained by the control computer from the displacement sensor located at the articulation joint, as represented by block 104. Using this articulation angle information, the control computer calculates, produces, and transmits a control signal designed to achieve the articulation angle requested by the automatic control, as illustrated by block 106. The control signal actuates the articulation cylinders to automatically rotate the front frame of the motor grader from its actual articulation angle to the requested articulation angle. The program waits for the next synchronized control time, as illustrated by 96, and then interprets the next automatic or manual control input signal, as represented by block 98.

If the operator has not requested automatic position control, the control computer produces and transmits a zero control signal, as illustrated by block 108. The program waits for the next synchronized control time, as illustrated by 96, and then interprets the next automatic or manual control input signal, as represented by block 98.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

INDUSTRIAL APPLICABILITY

The present invention relates generally to a method for automatically rotating a motor grader, having an electronic controller, a displacement sensor, articulation cylinders, and an input switch, to a predetermined articulation angle. The controller obtains the present articulation angle from the displacement sensor. Upon receipt of an input signal from the input switch requesting a predetermined articulation angle, the controller produces a unique control signal to actuate the articulation cylinders and, thereby, automatically rotate the motor grader from the present articulation angle to the predetermined articulation angle. In this manner, an operator can simply activate the input switch to automatically rotate the motor grader to a pre-programmed articulation angle, such as a maximum right articulation angle, a maximum left articulation angle, and/or a neutral articulation angle, which preferably would be programmed at the factory.

Other aspects, objects and advantages of the present invention can be obtained from a study of the drawings, the disclosure and the appended claims.

What is claimed is:

1. A method for automatically controlling an articulation angle of a motor grader comprising the steps of:

providing an electronic controller, a displacement sensor, articulation cylinders, and an input switch;

obtaining information from the displacement sensor indicating a present articulation angle of the motor grader;

receiving an input signal from the input switch requesting a predetermined articulation angle; and producing a control signal for actuating the articulation cylinders to rotate the motor grader from the present articulation angle to the predetermined articulation angle.

2. A method, as set forth in claim 1, wherein the displacement sensor is a rotary sensor.

3. A method as set forth in claim 1 wherein the predetermined articulation angle is one of a maximum right articulation angle, a maximum left articulation angle, and a neutral articulation angle.

4. A method as set forth in claim 3 wherein the motor grader includes a front frame having a longitudinal axis and a rear frame having a longitudinal axis and wherein the predetermined articulation angle is defined as the angle formed by the intersection of the longitudinal axis of the front frame and the longitudinal axis of the rear frame.

5. A method as set forth in claim 4 wherein the neutral articulation angle is defined as a zero degree angle formed between the intersection of the longitudinal axis of the front frame and the longitudinal axis of the rear frame.

* * * * *